US008028867B2

(12) United States Patent
Sterngold et al.

(10) Patent No.: US 8,028,867 B2
(45) Date of Patent: Oct. 4, 2011

(54) CONTAINER FOR DISPENSING A SUBSTANCE

(75) Inventors: Edouard Sterngold, London (GB); Michiel Olivier Schölvinck, Arnhem (NL)

(73) Assignee: MDS Global Holding Ltd., Gzira (MT)

( * ) Notice: Subject to any disclaimer, the term of this patent is extended or adjusted under 35 U.S.C. 154(b) by 658 days.

(21) Appl. No.: 12/064,729

(22) PCT Filed: Aug. 31, 2006

(86) PCT No.: PCT/EP2006/008577

§ 371 (c)(1),
(2), (4) Date: May 13, 2008

(87) PCT Pub. No.: WO2007/025773

PCT Pub. Date: Mar. 8, 2007

(65) Prior Publication Data

US 2008/0230571 A1 Sep. 25, 2008

(30) Foreign Application Priority Data

Sep. 2, 2005 (EP) ..... 05077012

(51) Int. Cl.
*B65D 47/10* (2006.01)

(52) U.S. Cl. ..... 222/541.4; 222/107; 222/215

(58) Field of Classification Search ..... 222/541.4, 222/95, 214, 215, 107
See application file for complete search history.

(56) References Cited

U.S. PATENT DOCUMENTS

| | | | | |
|---|---|---|---|---|
| 5,215,221 | A | 6/1993 | Dirksing | |
| 5,348,191 | A * | 9/1994 | Dekeyser | 222/107 |
| 6,085,942 | A * | 7/2000 | Redmond | 222/107 |

FOREIGN PATENT DOCUMENTS

| | | | |
|---|---|---|---|
| EP | 0 299 571 | A1 | 1/1989 |
| WO | WO 01/46037 | A1 | 6/2001 |
| WO | WO 2005/077811 | A2 | 8/2005 |

* cited by examiner

*Primary Examiner* — Frederick C Nicolas
*Assistant Examiner* — Melvin Cartagena
(74) *Attorney, Agent, or Firm* — Hoffmann & Baron, LLP

(57) ABSTRACT

The invention relates to a container (1) for containing a substance. The container comprises a preformed deformable body defining a filling cavity. The body has an opening (6) and an integral planar circumferential rim (5) surrounding said opening. The opening is closed by a cover sheet (7) which is sealed to the circumferential rim by means of a circumferential sealing seam (10). The circumferential rim has a flat dispensing part which is covered by the cover sheet, which cover sheet is sealed to the dispensing part by at least two outwardly directed sealing seams (11) joining the circumferential sealing seam and extending at a distance from one another from the circumferential sealing seam to the edge of the dispensing part. A weakened seal (14) with a pointed region (15) extends between the outwardly directed sealing seams. The pointed region is directed towards the cavity and the weakened sealing seam joins the respective outwardly directed sealing seams at a distance from the location (12) where the respective outwardly directed seals join the circumferential seal.

6 Claims, 4 Drawing Sheets

CONTAINER FOR DISPENSING A SUBSTANCE

CROSS-REFERENCE TO RELATED APPLICATIONS

This application is the National Stage of International Application No. PCT/EP2006/008577, filed Aug. 31, 2006, which claims the benefit of European Application No. EP 05077012.2, filed Sep. 2, 2005, the contents of which is incorporated by reference herein.

FIELD OF THE INVENTION

The present invention relates to dispensing of a substance from a container by means of a dispensing apparatus.

BACKGROUND OF THE INVENTION

The present invention proposes to dispense a substance from a container filled with a single portion of a substance. The container comprises a preformed deformable body, preferably made of sheet material, defining a filling cavity which body has an opening and an integral planar circumferential rim at least partly surrounding said opening, which opening is closed by a cover sheet which is sealed to the circumferential rim by means of a sealing seam.

According to the invention the substance, e.g. syrup for a soft drink or substance for coffee or other drinks is dispensed directly from the container into a serving container, e.g. a cup or a bottle. Also the water is dispensed into the serving container such that mixing takes place in the serving container thereby preventing the contamination of the dispensing apparatus with the substance.

SUMMARY OF THE INVENTION

In particular one aspect of the invention relates to a container according to claim 1.

In particular, one aspect of the invention relates to a container for containing a substance, comprising a preformed deformable body defining a filling cavity. Said body has an opening and an integral planar circumferential rim surrounding said opening. Said opening is closed by a cover sheet which is sealed to the circumferential rim by means of a circumferential sealing seam. The circumferential rim has a flat dispensing part which is covered by the cover sheet. Said cover sheet is sealed to the dispensing part by at least two outwardly directed sealing seams joining the circumferential sealing seam. Said outwardly directed sealing seams extend at a distance from one another from the circumferential sealing seam to the edge of the dispensing part. A weakened seal with a pointed region extends between the outwardly directed sealing seams. Said pointed region is directed towards the cavity such that upon pressurizing the content of the container by exerting a compression force on the wall the weakened seal breaks first at that pointed region and then breaks further towards the outwardly directed sealing seams such that a dispensing passage is formed between the two outwardly directed sealing seams, the cover sheet and the surface of the dispensing part. Said weakened sealing seam joins the respective outwardly directed sealing seams at a distance from the location where the respective outwardly directed seals join the circumferential seal.

Another aspect of the invention relates to a container for containing a substance, comprising a preformed deformable body defining a filling cavity. Said body has an opening and an integral planar circumferential rim surrounding said opening. Said opening is closed by a cover sheet which is sealed to the circumferential rim by means of a circumferential sealing seam. The circumferential rim has a flat dispensing part which is covered by the cover sheet. Said cover sheet is sealed to the dispensing part by at least two outwardly directed sealing seams joining the circumferential sealing seam. Said outwardly directed sealing seams extend at a distance from one another from the circumferential sealing seam to the edge of the dispensing part. A weakened seal with a pointed region extends between the outwardly directed sealing seams. Said pointed region is directed towards the cavity such that upon pressurizing the content of the container by exerting a compression force on the wall the weakened seal breaks first at that pointed region and then breaks further towards the outwardly directed sealing seams such that a dispensing passage is formed between the two outwardly directed sealing seams, the cover sheet and the surface of the dispensing part. The edge of the dispensing part, at least between the locations where the outwardly directed sealing seams come together with said edge, is curved in a convex manner.

According to this aspect, the edge of the dispensing part, at least between the locations where the outwardly directed sealing seams come together with said edge, is curved in a convex manner. This particular shape provides a more constant and thus more predictable direction in which the flow of substance is dispensed from the dispensing passage of the container. This reduces the risk of contamination of the dispensing apparatus and can also lead to a better mixing of the substance with the water in the serving container, e.g. a cup.

Preferably the container according to the invention is manufactured by a vacuum or thermo forming process. A flat sheet, preferably of plastic, preferably polystyrene, or aluminum, is placed in a vacuum or thermo forming apparatus with a forming die and multiple container bodies are formed simultaneously in the sheet by vacuum forming the filling cavities into the die. Then the sheet with the filling cavity is placed in a filling machine and filled with substance. The sheet with the container bodies is covered with a cover sheet preferably of covering foil that is sealed over it resulting in the containers being closed. Finally, the sheet with the closed containers is placed in a punch machine, where the perimeter of the circumferential rim of the body is formed by punching out waste material between the containers.

Preferably, the sheet of covering foil is manufactured of aluminum or another material, preferably a multilayer material. Alternatively, the cover sheet can be of material, e.g. from polystyrene or polyethylene, which can in a possible embodiment be manufactured by thermoforming as a preformed cover.

BRIEF DESCRIPTION OF THE DRAWINGS

The invention will become more apparent from the following description of preferred embodiments with reference to the drawings in which.

DETAILED DESCRIPTION OF PREFERRED EMBODIMENTS

Figure 2:
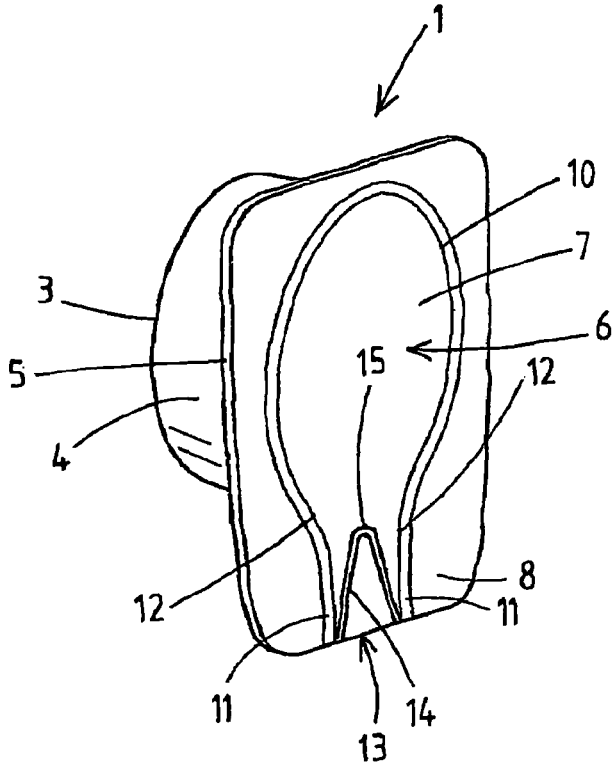
FIG. 2 shows a perspective view of a preferred embodiment of a container according to the invention.
Figure 3:
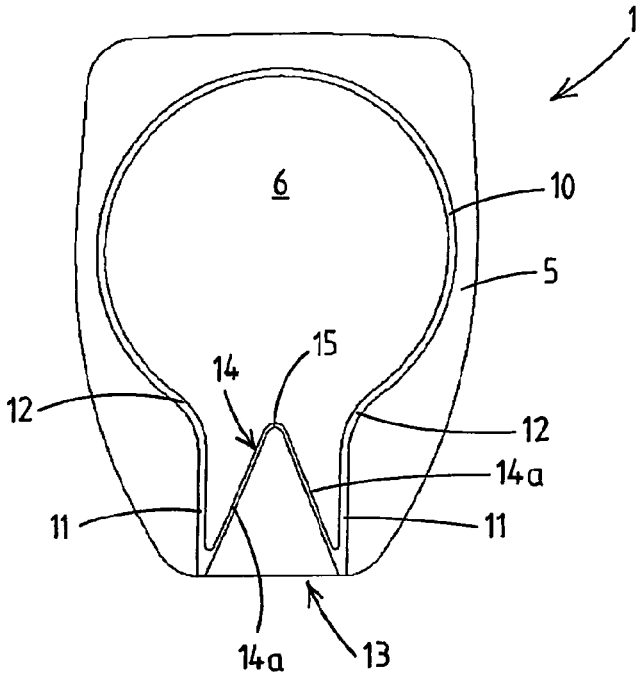
FIG. 3 shows a top elevational view of the container of FIG. 2.

In FIGS. 2 and 3 is shown a container 1 for containing a substance. The container 1 comprises a deformable body preferably made of plastic sheet material. The body can also be made of another material, e.g. aluminum or laminated cardboard paper. Preferably the body has a bottom 3 and a side wall 4 extending from the bottom 3, which define a filling cavity for substance to be dispensed. On the side opposite the bottom 3 a planar circumferential rim 5 is integral with the side wall 4 and extends outwardly therefrom. The circumferential rim 5 surrounds an opening 6.

A cover sheet 7 of foil material is sealed to the circumferential rim 5 by means of a circumferential sealing seam 10. The foil material can be a multilayer material. The circumferential rim 5 has an extending tab 8 which forms a flat dispensing part. The cover sheet 7 is also sealed to the top surface of the extending tab 8 by means of two outwardly directed sealing seams 11 joining the circumferential sealing seam 10 at locations 12. The outwardly directed sealing seams 11 extend substantially parallel at a distance from one another from the circumferential sealing seam 10 to the edge 13 of the dispensing part 8.

Between the outwardly directed sealing seams a weakened seal 14 extends. The weakened seal 14 has a pointed shape, preferably a V shape with two obliquely inwardly extending legs 14a as is shown in FIGS. 2 and 3. The point 15 of the V is thus directed towards the cavity 6.

The weakened sealing seam 14 joins the respective outwardly directed sealing seams 11 at or near the edge 13 of the dispensing part 8 of the circumferential rim 5. Because the weakened sealing seam 14 joins at a distance from the location 12 where the respective outwardly directed seals 11 join the circumferential seal 10 the separation of the covering sheet 7 and the circumferential rim 5 will not progress from the weak seal to the stronger circumferential seal which ensures that fluid will only escape through the dispensing passage defined by the outwardly directed seals 11.

Figure 4:
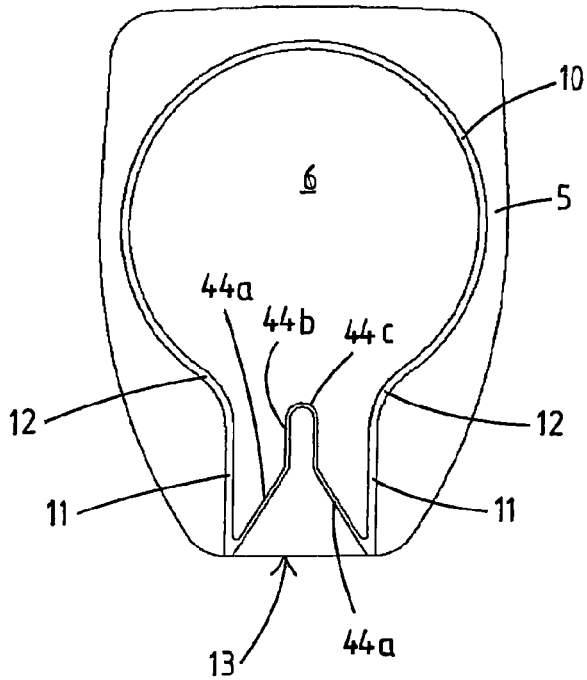
FIG. 4 shows a top elevational view of another preferred embodiment of a container according to the invention.

In FIG. 4 another example of a pointed seal is shown. In this figure corresponding elements are designated with the same reference numerals as in FIGS. 2 and 3. The weakened sealing seam 44 in this embodiment has two parts 44*a* that join the respective outwardly extending sealing seams 11 at the edge 13 of the dispensing part 8 and from there extend obliquely towards the other sealing seam 11 and in the direction of the cavity 6. The two parts 44*a* are connected by a loop 44*b* with a top 44*c* pointing towards the cavity 6.

Figure 1:
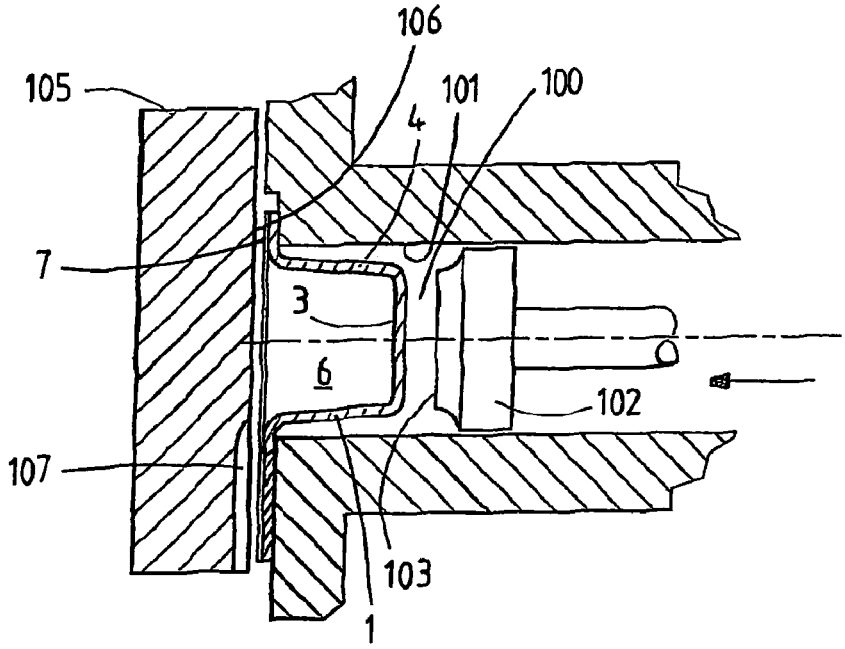
FIG. 1 shows schematically a container according to the invention placed in the compressing means of a dispensing apparatus.

In FIG. 1 is shown a part of a dispensing apparatus for dispensing beverages. The part shown is the compressing part of the dispensing apparatus which comprises a variable compression chamber 100 defined by a circumferential wall 101 and a front surface 103 of a moveable piston 102 which is moveable between a retracted and an advanced position.

In FIG. 1 the piston is shown in the retracted position. In the compression chamber 100 is placed the body of the container 1. The top of the container is engaged by a covering lid 105 with a support surface 106 that supports the cover sheet 7 of the container 1. The covering lid 105 has a recess 107 in which the covering sheet 7 is allowed to bulge out upon pressurization of the container 1.

The container 1 with the substance can be opened by making use of the deformability of the cover sheet 7. The container 1 is held in the compressing means of the dispensing apparatus and the cover sheet 7 is engaged with the support surface 106. Then the piston 102 is moved from the retracted position towards the advanced position as is indicated by the arrow, thereby compressing the container body. The support surface 106 supports the cover sheet 7 but allows at the recess 107 that it can bulge out between the outwardly directed sealing seams 11.

The weak sealing seam 14 or 44 is first broken at the pointed region 15 or 44*c*. The separation from the cover sheet 7 from the surface of the dispensing part 8 then progresses from the center along the weakened sealing seam 14, 44 towards the outwardly directed sealing seams 11 under influence of the pressure of the substance. A dispensing passage is formed between the two outwardly directed sealing seams 11, the cover sheet 7 and the surface of the dispensing part 8. This passage has in the beginning a small passage opening near the cavity, but the passage opening gradually increases and moves gradually towards the edge 13 by the breaking of the weak seal 14, 44. This provides the advantage that the pressure that is built up in the container 1 is released gradually, which has the effect that the substance will not splash out of the container 1 and contaminate the dispensing apparatus.

How far the weakened sealing seam 14 is torn depends on the pressure of the substance to be dispensed. This pressure is partly depending on the viscosity of the substance. A substance with a high viscosity will result in a higher pressure and thus a further torn weak seal 14, 44 and thus a wider passage opening, which is desirable with a viscous substance to get a sufficient flow. A substance with a low viscosity will result in a lower pressure and thus a lesser torn weak seal 14, 44 and thus a less wide passage opening, which is desirable with a low viscous substance to prevent splashing.

Figure 6:
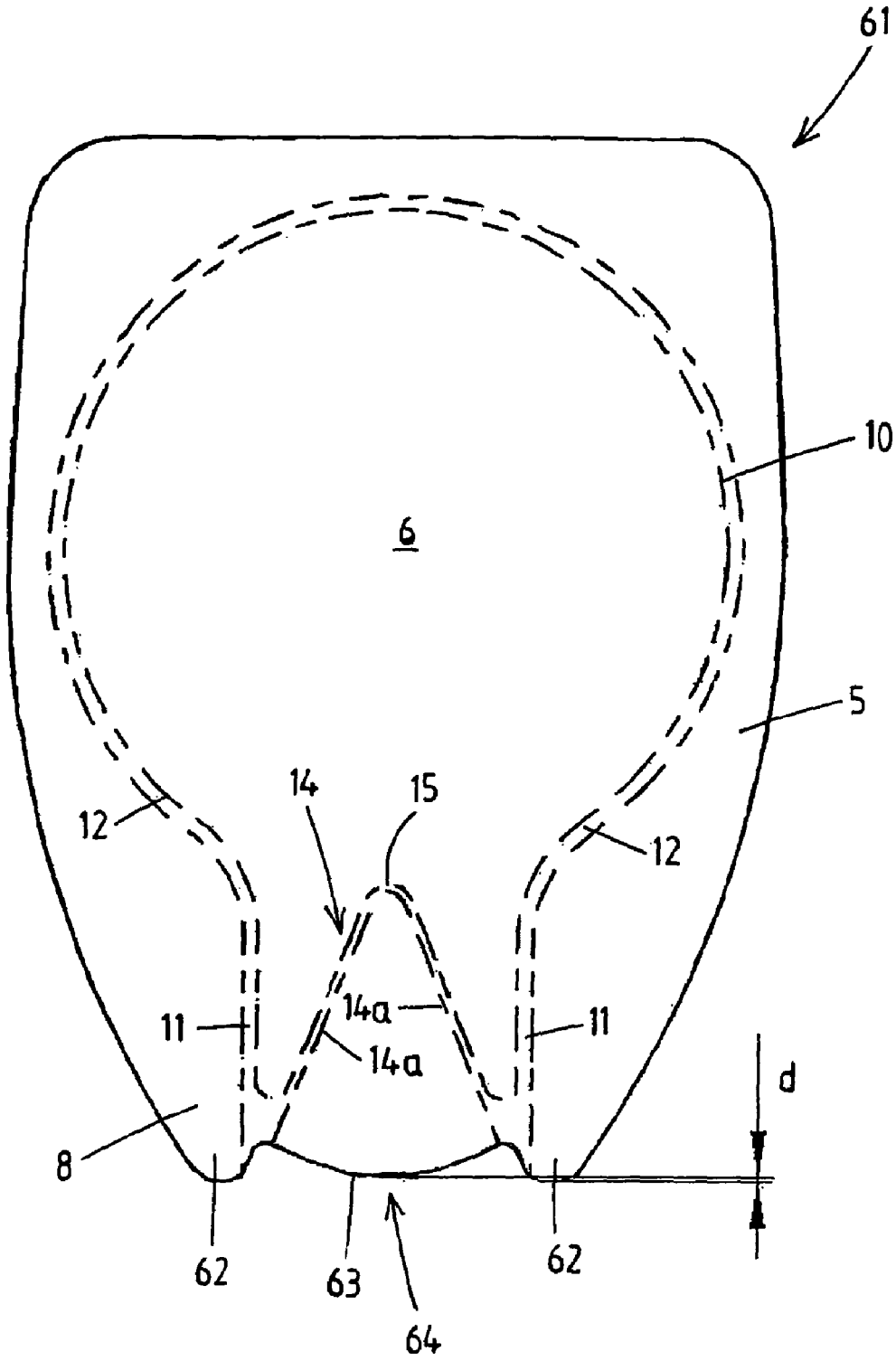
FIG. 6 shows a top elevational view of yet another preferred embodiment of the invention.

In FIG. 6 is shown another container 61 which corresponds mainly to the container 1 shown in FIG. 2 and FIG. 3. Corresponding elements are therefore designated with the same reference numerals. The container 61 differs from container 1 in that the edge 63 of the flat dispensing part of the container 61 is curved, whereas the edge 13 of the flat dispensing part of the container 1 is straight. The edge 63 is curved in a convex manner, wherein the curve lies in the plane of the extending tab 8. The curved edge 63 extends between the legs 14*a* of the weak seal 14.

Such a curved shape of the edge 63 has for an effect with respect to a straight edge, that the substance flows out of the dispensing passage in constant direction, which is preferably such that it is directed to the bottom of the cup or other serving container. Preferably the flow is directed between 0° and 10° backwards or forwards. This has as an advantage that the risk of contamination of the dispensing apparatus is further reduced. Furthermore it is envisaged to dispense first a small amount of water in the serving container before the substance is dispensed in the serving container. By directing the flow in an area between 0° and 10° forward or backward, the flow of substance is dispensed directly in the water already present in the dispensing container, which improves the mixing of the two.

Furthermore, in the specific application where the substance and the water are mixed in the cup, it is preferred that the jet of water and the jet of substance are converging in the cup to obtain a good mixing of the two. The shape of the edge 63 provides a predictable flow direction of the substance out of the dispensing passage, such that the converging with the water jet can be readily arranged.

Thus, the convexly curved shape of the edge 63 of the flat dispensing part has a beneficial effect on the predictability of the direction of the flow of substance.

One reason for that is that the substance has the tendency to adhere to the material of the dispensing part of the container 61. The curved shape, which is symmetrical with respect to the symmetry face of the container 61, causes the flow to be guided to the middle 64 of the exhaust of the dispensing passage. Thereby a more constant direction of the flow of substance is provided.

Another reason is that during the manufacturing of the containers 1, 61, the shape of the circumferential rim of the container is punched out in a punching machine after the covering foil has been sealed to the upper side of the circumferential rim 5. The punching takes place by a cutting tool coming from above. Therefore, first the covering foil is cut, and then the underlying plastic of the circumferential rim 5 and the extending tab 8 thereof is cut. By this cutting action the covering foil is slightly wrapped around the plastic at the edge of the circumferential rim and the dispensing part formed by the extending tab 8. Since the covering foil is tensioned, this would lead with a straight edge 13 (cf. FIG. 3) to a deviation in the flow of substance, because the substance is, as it were, guided backwards around the straight edge 13 of the dispensing part. With a rounded edge 63 (cf. FIG. 6), which prevents the covering foil to be tightly tensioned around the edge after punching, the deviation of the flow is to a great extent reduced.

On either side of the edge 63 there are provided protective protrusions 62. The most extending point of these protrusions 62 is situated beyond the centre point of the curved edge 63, which in FIG. 6 is indicated by a distance d. The protective protrusions 62 protect the curved edge 63 against damage by impact. Damage on the edge 63 can influence the direction of the flow of substance, which risk is now reduced.

Figure 5:
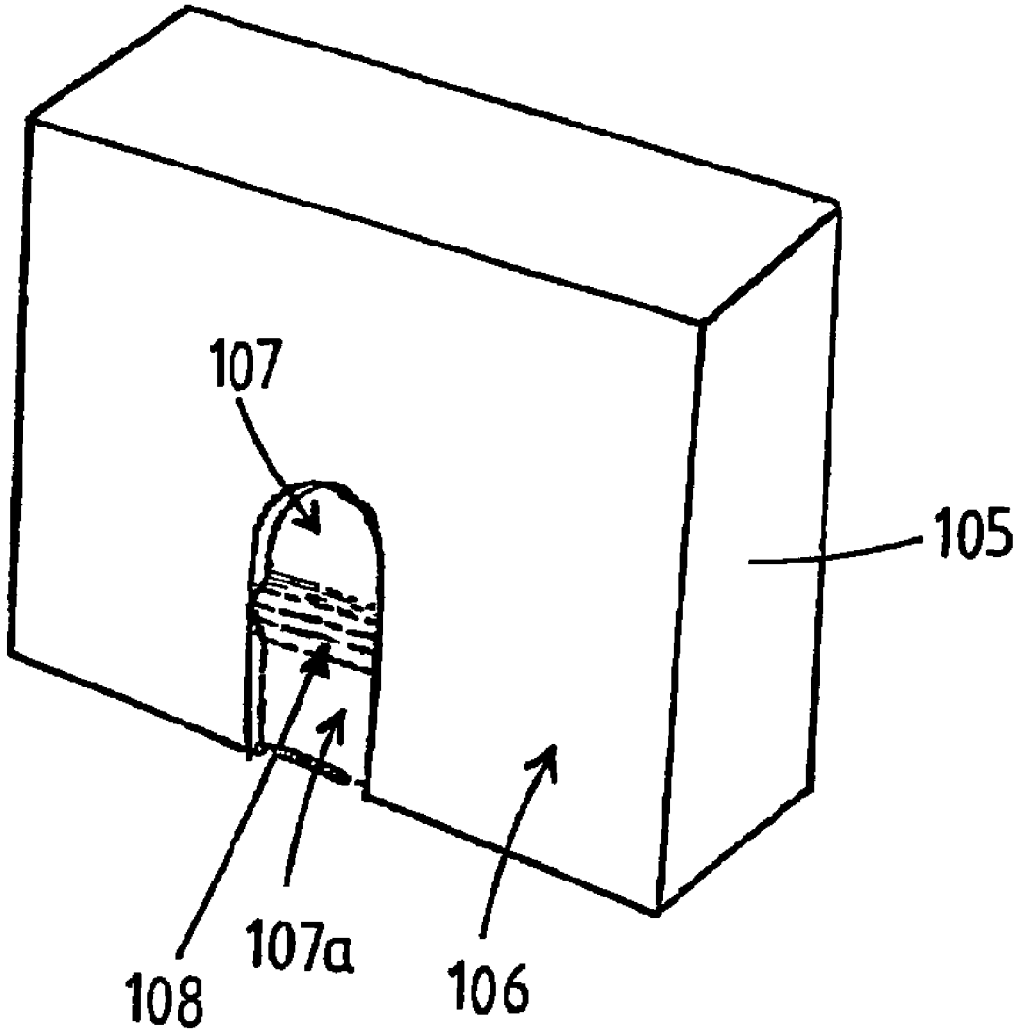
FIG. 5 shows a preferred embodiment of the covering lid of the compressing means of FIG. 1.

In FIG. 5 another aspect of the invention is shown. FIG. 5 shows the covering lid 105 with the recess 107 in it, in which the dispensing passage will bulge out. On the bottom 107*a* of the recess 107 is advantageously provided an elevation 108. This elevation 108 results in a narrower dispensing passage which has a throttling effect on the flow of substance out of the container 1. This has the beneficial effect that splashing and contamination of the dispensing apparatus is prevented.

What is claimed is:

1. Container for containing a substance, comprising a preformed deformable body defining a filling cavity which body has an opening and an integral planar circumferential rim surrounding said opening, which opening is closed by a cover sheet which is sealed to the circumferential rim by means of a circumferential sealing seam, wherein the circumferential rim has a flat dispensing part which is covered by the cover sheet, which cover sheet is sealed to the dispensing part by at least two outwardly directed sealing seams joining the circumferential sealing seam, which outwardly directed sealing seams extend at a distance from one another from the circumferential sealing seam to the edge of the dispensing part, wherein a weakened sealing seam with a pointed region extends between the outwardly directed sealing seams, which pointed region is directed towards the cavity such that upon pressurizing the content of the container by exerting a compression force on the wall the weakened sealing seam breaks first at that pointed region and then breaks further towards the outwardly directed sealing seams such that a dispensing passage is formed between the two outwardly directed sealing seams, the cover sheet and the surface of the dispensing part, wherein the weakened sealing seam joins the respective outwardly directed sealing seams at a distance from the location where the respective outwardly directed seals join the circumferential seal.

2. Container according to claim 1, wherein the weakened sealing seam is substantially V-shaped.

3. Container according to claim 1, wherein the weakened sealing seam joins the outwardly directed sealing seams at or near the edge of the dispensing part of the circumferential rim.

4. Container according to claim 1, wherein the edge of the dispensing part, at least between the locations where the outwardly directed sealing seams come together with said edge, is curved in a convex manner.

5. Container according to claim 1, wherein adjacent from the edge of the dispensing part are provided protective protrusions which extend beyond the most outward point of the edge so as to protect the edge against damaging.

6. Container for containing a substance, comprising a preformed deformable body defining a filling cavity which body has an opening and an integral planar circumferential rim surrounding said opening, which opening is closed by a cover sheet which is sealed to the circumferential rim by means of a circumferential sealing seam, wherein the circumferential rim has a flat dispensing part which is covered by the cover sheet, which cover sheet is sealed to the dispensing part by at least two outwardly directed sealing seams joining the circumferential sealing seam, which outwardly directed sealing seams extend at a distance from one another from the circumferential sealing seam to the edge of the dispensing part, wherein a weakened sealing seam with a pointed region extends between the outwardly directed sealing seams, which pointed region is directed towards the cavity such that upon pressurizing the content of the container by exerting a compression force on the wall the weakened sealing seam breaks first at that pointed region and then breaks further towards the outwardly directed sealing seams such that a dispensing passage is formed between the two outwardly directed sealing seams, the cover sheet and the surface of the dispensing part, wherein the edge of the dispensing part, at least between the locations where the outwardly directed sealing seams come together with said edge, is curved in a convex manner.

* * * * *